US010676935B1

(12) United States Patent
Huang

(10) Patent No.: US 10,676,935 B1
(45) Date of Patent: Jun. 9, 2020

(54) HEAT EXTRACTION, WATERPROOF, AND DAYLIGHTING ROOF DEVICE

(71) Applicant: Daniel Huang, Taichung (TW)

(72) Inventor: Daniel Huang, Taichung (TW)

( * ) Notice: Subject to any disclaimer, the term of this patent is extended or adjusted under 35 U.S.C. 154(b) by 0 days.

(21) Appl. No.: 16/519,351

(22) Filed: Jul. 23, 2019

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC ..... E04D 13/174; E04D 13/0481; E04D 13/0445; E04D 13/17; E04D 2013/045; F24F 27/02; F24F 2221/52; F24F 7/04
See application file for complete search history.

(56) References Cited

U.S. PATENT DOCUMENTS 1,800,278 A * 4/1931 Bourke ..... F24F 7/02 454/365
2,470,201 A * 5/1949 Werner ..... F24F 7/02 454/275
2,601,423 A * 6/1952 Allman ..... F24F 7/02 454/363
3,371,590 A * 3/1968 Korff ..... F24F 7/02 454/363
3,382,792 A * 5/1968 Howard ..... F24F 7/02 454/38
4,520,713 A * 6/1985 Arfsten ..... F24F 7/02 454/363
4,848,653 A * 7/1989 Van Becelaere ..... F24F 7/02 236/49.3
4,850,265 A * 7/1989 Raisanen ..... F24F 7/02 454/275
6,439,991 B1 * 8/2002 Jarnot ..... F24F 7/02 135/93
2005/0233691 A1 * 10/2005 Horton ..... E04D 13/17 454/366
2014/0220882 A1 * 8/2014 Huang ..... E04D 13/174 454/364
2016/0130817 A1 * 5/2016 Huang ..... F24F 7/02 52/198
2016/0177572 A1 * 6/2016 Huang ..... E04D 13/176 454/365
2016/0362895 A1 * 12/2016 Huang ..... E04D 13/0481
2020/0011554 A1 * 1/2020 Chang ..... F24F 7/02

* cited by examiner

*Primary Examiner* — Brian D Mattei
(74) *Attorney, Agent, or Firm* — Muncy, Geissler, Olds & Lowe, P.C.

(57) ABSTRACT

The present invention is a heat extraction, waterproof, and daylighting roof device, which includes a water leakage top assembled above a roof. The water leakage top has a first air vent and a left end edge. A left extension water leakage top, a right extension water leakage top, an expel air vent, and a guide plate are mounted above the first air vent, and water leakage holes are provided between the left extension water leakage top and the water leakage top. The guide plate is positioned below the expel air vent; the guide plate is provided with an upward facing right crooked plate and an upward facing left crooked plate on two sides thereof. The left crooked plate is provided with a plurality of overflow holes, during heavy rain, the guide plate provides a function similar to an overflow container that prevents spilling over to the first air vent.

8 Claims, 6 Drawing Sheets

HEAT EXTRACTION, WATERPROOF, AND DAYLIGHTING ROOF DEVICE

BACKGROUND OF THE INVENTION

(a) Field of the Invention

The present invention relates to a heat extraction, waterproof, and daylighting roof device, and more particularly to a heat extraction, waterproof, and daylighting roof device that includes a guide plate configured with at least one side upward bend to guide internal flow, which apart from guiding flow also applies the rising force of hot air and the Bernouilli principle to cause the hot air to stream out and be expelled outside the house. Both sides of the guide plate are able to expel hot air to outside the house; moreover, the guide plate is also able to contain excessive rain water during heavy rain, providing superior water stoppage and water discharge that is similar in function to an overflow container.

(b) Description of the Prior Art

Referring to FIG. 1, which shows a conventional heat extraction and waterproof roof device of the prior art, wherein a water leakage top 11 is assembled on a roof 10. The water leakage top 11 is an inclined top plate (an enameled corrugated plate), and a first air vent 12 is provided in the water leakage top 11; moreover, a heat extraction and waterproof roof device 13 is assembled above the first air vent 12. The device 13 mainly comprises a left water leakage top 14 and a right water leakage top 15, wherein the left water leakage top 14 and and the right water leakage top 15 are joined to the water leakage top 11 using a frame (not shown in the drawing). The right water leakage top 15 is assembled from a right top plate 151, a long internal plate 152, and a right sloping plate 153, wherein the right top plate 151 and the long internal plate 152 are parallel to the water leakage top 11. There is a drop height between the right top plate 151 and the long internal plate 152, and the right top plate 151 is connected to the long internal plate 152 using a stop plate 154. The right sloping plate 153 is positioned on the right side of the right top plate 151, and the long internal plate 152 is positioned on the left side of the right top plate 151. The left water leakage top 14 is positioned on the left side of the right water leakage top 15, wherein the left water leakage top 14 comprises a left top plate 141 and a left sloping plate 142. The left top plate 141 is parallel with the water leakage top 11, and the lower side of the left sloping plate 142 is provided with water leakage holes 143 that expel rain water (or the corrugated shape of the water leakage top 11 is relied on to expel rain water from between the left sloping plate 142 and the water leakage top 11). A second air vent 111 is provided between the water leakage top 11 and the long internal plate 152; a third air vent 112 is provided between the long internal plate 152 and the left sloping plate 142; a fourth air vent 113 is provided between the long internal plate 152 and the left top plate 141; and an expel air vent 16 is provided between the left top plate 141 and the right top plate 151. In accordance with the upward flow of heat convection, hot air in the interior of a house dissipates upward and passes through the first air vent 12, the second air vent 111, the third air vent 112, and the fourth air vent 113 to be expelled from the air vent 16. The above describes a heat extraction and waterproof roof device of the prior art.

One shortcoming of the heat extraction and waterproof roof device of the prior art includes the hindered discharge of heat flow. Moreover, opening diameters of the first air vent 12, the second air vent 111, the third air vent 112, the fourth air vent 113, and the air vent 16 vary in size and do not gradually narrow one after another, thus preventing rapid expelling of hot air. Furthermore, the lower side of the left sloping plate 142 provided with the water leakage holes 143 that expel rain water bring about an overflow of rain water during a heavy downpour, or the upward rising force of hot air blows the rain water, with the apprehension of causing a reverse flow of the rain water to the first air vent 12, which then enters the interior of the house. This is another shortcoming of the above-described prior art that results in rain water leaking from the roof.

Referring to FIG. 2, which shows another heat extraction and waterproof roof device of the prior art, comprising a roof 20, at least one water leakage top 21, a cover plate 22, and a side stop plate 23, wherein the roof 20 is the top portion of a building mounted with two of the water leakage tops 21, with one of the water leakage tops 21 positioned on one side of the roof 20. The water leakage top 21 is provided with a through air vent 211, and an air discharge and heat dissipation device is mounted above the water leakage top 21. The air discharge and heat dissipation device is fitted with the cover plate 22 and the side stop plate 23, which is mounted on the water leakage top 21 and comprises a horizontal plate 231 and an upright plate 232. The upright plate 232 is mounted on the water leakage top 21, the horizontal plate 231 extends horizontally upward from the upright plate 232, and the bottom portion of the side stop plate 23 is provided with water leakage holes 233. The cover plate 22 is mounted on the water leakage top 21 (close to the top portion of the roof 20), and is positioned above the through air vent 211. The cover plate 22 and the side stop plate 23 are correspondingly side configured on the left and right sides of the water leakage top 21, wherein one side of the cover plate 22 is positioned above the water leakage top 21, and the other side of the cover plate 22 is a guide plate 221. The guide plate 221 is adjacent to the side stop plate 23 but with a clearance therebetween, and the guide plate 221 comprises a vertical plate 222 and a sloping plate 223. The vertical plate 222 is a downward section at one end of the cover plate 22, while the sloping plate 223 is an approximately horizontal extension of the vertical plate 222. The sloping plate 223 of the guide plate 221 slopes upward at an angle with a small sectional downturn at the top end, which blocks forward flow of rain water along the back surface thereof. An upper air vent 24 is provided between the sloping plate 223 of the guide plate 221 and the horizontal plate 231 of the side stop plate 23; a middle air vent 25 is provided between the guide plate 221 and the upright plate 232 of the side stop plate 23; and a lower air vent 26 is provided between the guide plate 221 and the water leakage top 21. Moreover, the opening diameter of the through air vent 211 is larger than the opening diameter of the lower air vent 26; the opening diameter of the lower air vent 26 is larger than the opening diameter of the middle air vent 25; and the opening diameter of the middle air vent 25 is larger than the opening diameter of the upper air vent 24; accordingly, the successive opening diameters of the through air vent 211, the lower air vent 26, the middle air vent 25, and the upper air vent 24 present the largest opening, next largest, medium opening, to the smallest opening. When hot air is produced inside a house, the hot air flows upward toward the through air vent 211, and then flows through the lower air vent 26 to the middle air vent 25, and is finally expelled from the upper air vent 24. Based on the chimney effect (which points to air rising along a space temperature gradient inside a room, producing an air convection effect), the rising force of hot air which flows through larger to smaller opening diameters of the air vents is used to cause the hot air to stream out, and then uses the inclined design of the side stop plate 23 and the cover plate 22 at the front and rear of the upper air vent 24, respectively, in addition to applying the Bernouilli principle to make use of strong gusts of wind on the roof to speed up drawing out of the hot air, to achieve the object of natural and rapid ventilation. This invention of the prior art is a previous invention of the applicant of the present invention, which received favorably good reviews after launching the product on the market.

Referring to FIG. 3, which shows another heat extraction and waterproof roof device of the prior art provided with an upper cover plate 31 and a lower cover plate 32, two side wall plates 33, a guide plate 34, and a second guide plate 341 assembled on a roof, wherein a second deflecting flow channel 361 is formed between an upward bent end of the guide plate 34 that faces an air outlet 35 and a guide connecting piece 36. Accordingly, a deflecting flow channel 331 creates a bidirectional air flow effect that connects a guide air vent 332 with the air outlet 35. The second guide plate 341 is assembled below the guide plate 34, and a third deflecting flow channel 37 is formed between the second guide plate 341 and the guide plate 34. Accordingly, the deflecting flow channel 331 and the second deflecting flow channel 361 guide hot air below a roof plate 30 to flow along the directions of the arrows depicted in the diagram, with the upper and lower ends of the guide plate 34 and the second guide plate 341 respectively deflecting the hot air, before finally being expelled outward from the air outlet 35. This prior art has the single guide plate 34 or is provided with the additional second guide plate 341, and is additionally configured with the second deflecting flow channel 361, all of which are improvements on the above-described prior art patent. However, in order to prevent rain water from entering the interior of a house, the device is designed with multiple layers of meandering spaces, which counter the rising force of the hot air flow, resulting in a downward path, and, instead, brings about an increase in the slowing down of the hot air flow, this countering of the rising force phenomenon results in a downward accumulation of the hot air, making it difficult for the hot air to flow and providing a poor heat extraction effect.

The above-described conventional air discharge and heat dissipation device products (shown in FIG. 1 and FIG. 3) have shortcomings mainly because downward flow paths countering the rising force of hot air are intimately related to the air discharge and heat dissipation device slowing down the flow of the hot air, thus, this countering of the rising force phenomenon makes it difficult for the hot air to flow and easily brings about tardy outflow, resulting in downward accumulation.

Referring to FIG. 4, which shows the X-Y axis heat extraction coordinate index of the above-described conventional air discharge and heat dissipation device products (shown in FIG. 1 and FIG. 3), wherein the X-axis is the coordinate positions of horizontal displacement of hot air flow, and the Y-axis is the coordinate positions of vertical displacement of hot air flow. When the coordinate positions of hot air flow is on the negative Y-axis, a phenomenon occurs that counters the rising force, making it difficult for the hot air to flow, and results in an inferior heat extraction effect.

SUMMARY OF THE INVENTION

The primary object of the present invention lies in providing a guide plate having a left and a right crooked plate that effect a diverting flow function, and also uses the rising force of an upward heat flow to cause streaming out of hot air; moreover, the Bernouilli principle is further applied by making use of strong gusts of wind on the roof of a house to speed up expelling the hot air from the interior of the house. Furthermore, the left and right crooked plates of the guide plate prevent rain water from flowing back along the guide plate when hot air is being expelled through a second air vent and a third air vent.

Another objective of the present invention lies in providing the guide plate with the facing left and right crooked plates, wherein the right crooked plate is positioned higher than the left crooked plate, which has the function similar to that of an overflow container. The overflow area of the guide plate is beyond a first air vent and can temporarily store water during extremely heavy rain, thus preventing the overflow of rain water that would otherwise normally fall into the first air vent and then into the interior of a house.

Yet another object of the present invention lies in providing the guide plate and a second right crooked plate and a second left crooked plate that are separated; moreover, the guide plate is configured with a single left sloping plate and a single right sloping plate, which provide the guide plate with multiple functions including air discharge, water storage, water stoppage, and preventing water leakage.

Yet another object of the present invention lies in providing a configurational structure that is suitable for assembly on a flat surface rooftop.

Accordingly, a heat extraction, waterproof, and daylighting roof device of the present invention comprises a water leakage top that is assembled on a roof, wherein the water leakage top is a top plate, the first air vent is provided in the water leakage top and configured with a left end edge and a right end edge. A left extension water leakage top, a right extension water leakage top, and the sloping guide plate are assembled above the first air vent. The right extension water leakage top comprises a right sloping plate and a right top plate. The left extension water leakage top is positioned on the left side of the right extension water leakage top, and the left extension water leakage top comprises a left top plate and a left sloping plate. Water leakage holes are provided between the left sloping plate and the water leakage top. The left top plate and the right top plate are approximately parallel with the water leakage top with an expel air vent provided therebetween. The left extension water leakage top and the right extension water leakage top and two side elevations therebetween form an elevated body. The guide plate is positioned below the left extension water leakage top and the right extension water leakage top and above the water leakage top.

The present invention is characterized in that: the guide plate is provided with the upward facing right crooked plate and the left crooked plate on two sides thereof, wherein the guide plate is positioned on the connecting line between the end portion of left top plate and the left end edge of the first air vent. The overflow area of the guide plate is beyond the first air vent. A second air vent is formed between the guide plate and the water leakage top; a third air vent is formed between the left crooked plate and the left sloping plate; and a fourth air vent is formed between the left crooked plate and the left top plate. The opening diameter of the first air vent is larger than the opening diameter of the second air vent, and a fifth air vent is formed between the right crooked plate and the right extension water leakage top. The right crooked plate is positioned higher than the left crooked plate enabling the guide plate to guide the flow of hot air and prevent reverse flow of rain water when hot air is being expelled, as well as enabling temporary storage of accumulated rain water during heavy rain, thereby preventing spilling over to the first wind vent.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 5:
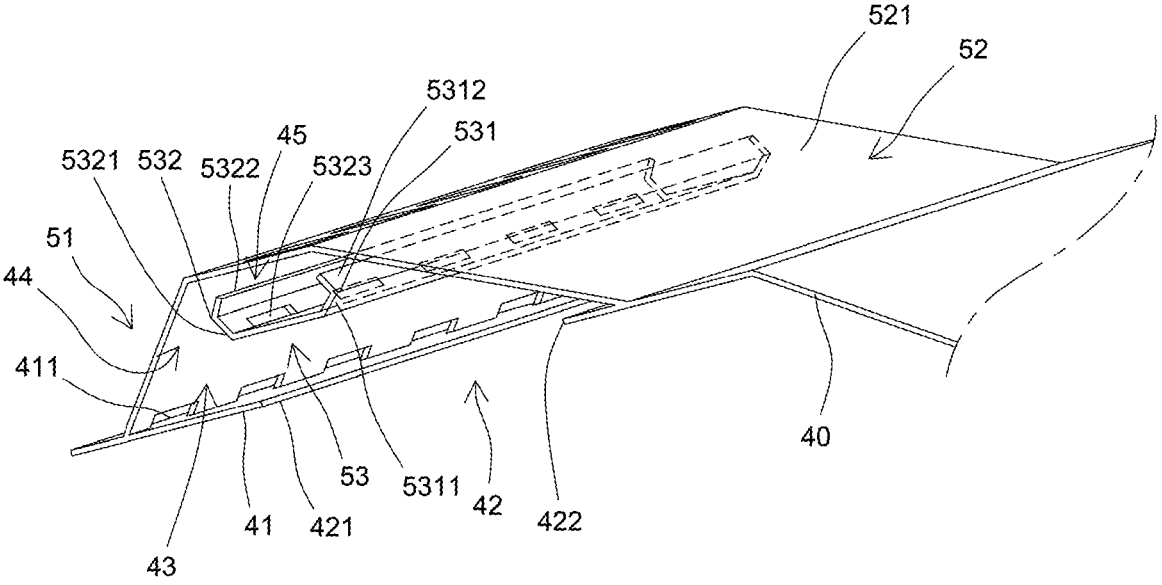
FIG. 5 is a three-dimensional schematic view of a first embodiment of the present invention.
Figure 6:
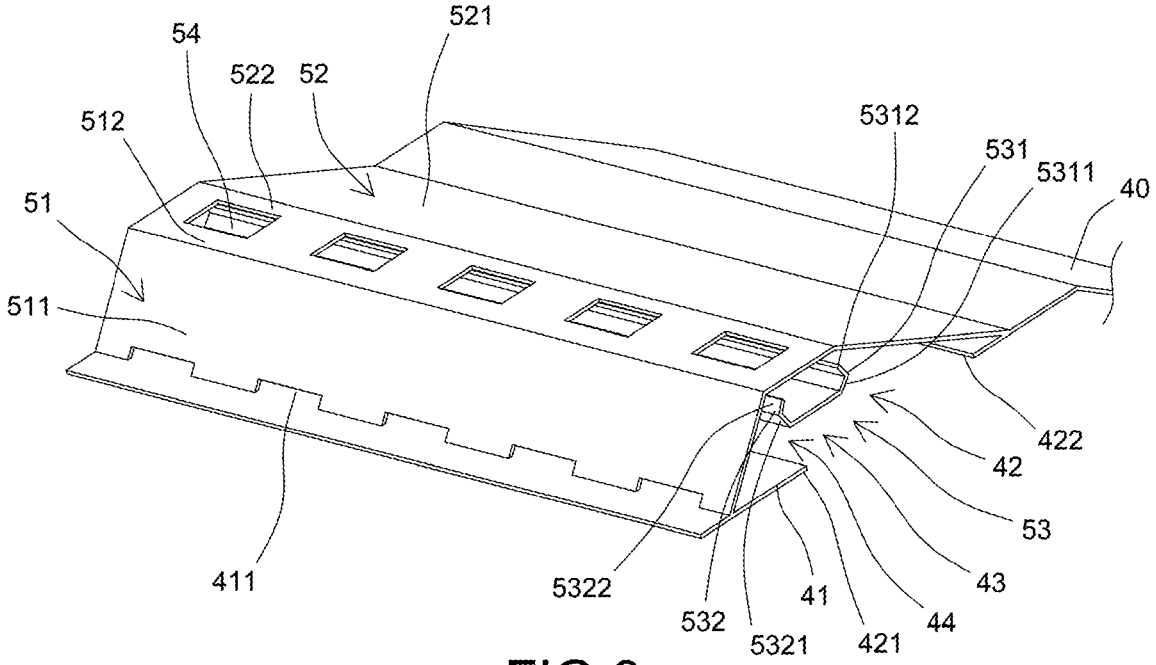
FIG. 6 is a three-dimensional schematic view from another viewing angle of the first embodiment of the present invention.
Figure 7:
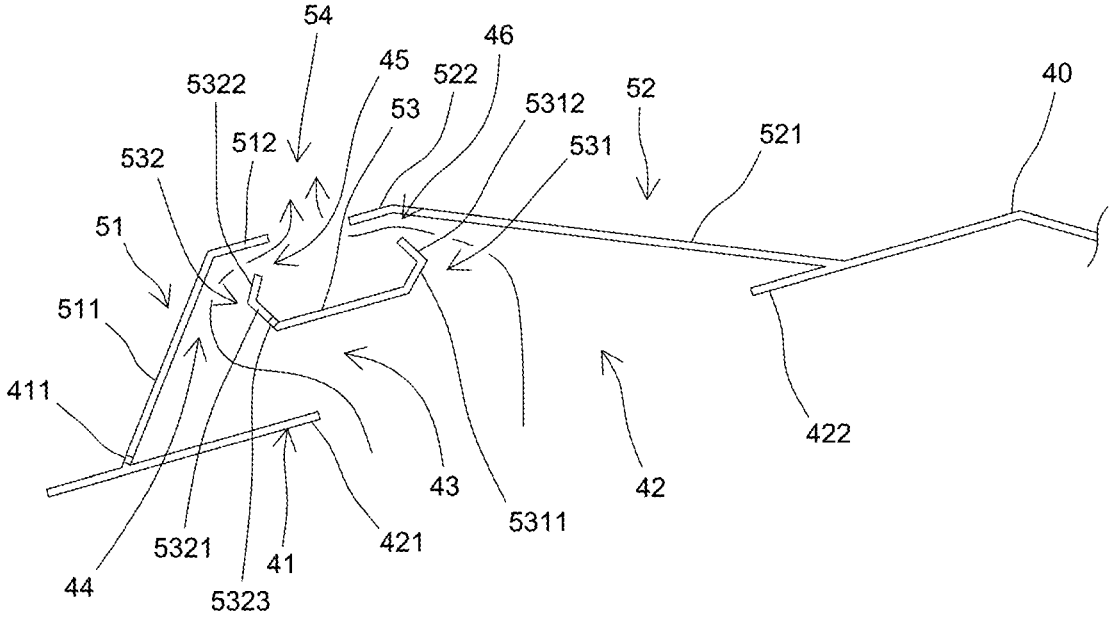
FIG. 7 is a cross-section schematic view of the first embodiment of the present invention.

Referring to FIGS. 5, 6, and 7, which show a first embodiment of the present invention, wherein a water leakage top 41 is assembled on two sides of a roof 40. The water leakage top 41 is an inclined top plate (or is an inclined enameled corrugated plate), a first air vent 42 is provided in the water leakage top 41, and two sides of the first air vent 42 is configured with a left end edge 421 and a right end edge 422. A left extension water leakage top 51, a right extension water leakage top 52, and a sloping guide plate 53 are assembled above the first air vent 42. The left extension water leakage top 51, the right extension water leakage top 52, and the guide plate 53 all use a frame (not shown in the drawings) to realize secure fastening above the water leakage top 41. The right extension water leakage top 52 comprises a right sloping plate 521 and a right top plate 522. The left extension water leakage top 51 is positioned on the left side of the right extension water leakage top 52, and the left extension water leakage top 51 comprises a left sloping plate 511 and a left top plate 512. The left top plate 512 and the right top plate 522 are approximately parallel with the water leakage top 41 with an expel air vent 54 provided therebetween. Water leakage holes 411 are provided between the left sloping plate 511 and the water leakage top 41 (or the water leakage top 41 is an inclined enameled corrugated plate, and the left sloping plate 511 is mounted on the water leakage top 41, thereby enabling the concave corrugations in the enameled corrugated plate to be used to discharge water). The left extension water leakage top 51 and the right extension water leakage top 52 are assembled to form an elevated body and are both made from light-transmitting material, thereby enabling light to pass through the light-transmitting material of the left extension water leakage top 51 and the right extension water leakage top 52 as well as the expel air vent 54 to illuminate the interior of the room below. The guide plate 53 is positioned below the left extension water leakage top 51 and the right extension water leakage top 52 and above the water leakage top 41 (that is, below the expel air vent 54). The guide plate 53 is an inclined plate, the right side of which is provided with an upward facing right crooked plate 531, and the left side of the guide plate 53 is provided with an upward facing left crooked plate 532. The right crooked plate 531 and the left crooked plate 532 face each other, with the right crooked plate 531 positioned higher. The left crooked plate 532 is an inverted V-shaped plate, which comprises a left lower plate 5321 and a left upper plate 5322, with the left lower plate 5321 provided with a plurality of overflow holes 5323. The right crooked plate 531 is an inverted V-shaped plate, which comprises a right lower plate 5311 and a right upper plate 5312. The guide plate 53 is positioned on the connecting line between the left top plate 512 and the left end edge 421 of the first air vent 42. The overflow area of the plurality of overflow holes 5323 in the left crooked plate 532 is beyond the first air vent 42. A second air vent 43 is formed between the guide plate 53 and the water leakage top 41; a third air vent 44 is formed between the left crooked plate 532 and the left sloping plate 511; and a fourth air vent 45 is formed between the left crooked plate 532 and the left top plate 512 (as depicted in FIG. 7). The opening diameter of the first air vent 42 is larger than the opening diameter of the second air vent 43; the opening diameter of the second air vent 43 is larger than the opening diameter of the third air vent 44; and the opening diameter of the third air vent 44 is larger than the opening diameter of the fourth air vent 45. Furthermore, a fifth air vent 46 is formed between the right crooked plate 531 and the right extension water leakage top 52.

According to the improvements in the aforementioned structure of the first embodiment of the present invention, heat flow in the interior of a house rises upward and passes through the first air vent 42, the second air vent 43, the third air vent 44, and the fourth air vent 45 to arrive at the expel air vent 54, whereupon the rising force of the hot air is used to cause the hot air to stream out. The Bernouilli principle is also applied to make use of the strong gusts of wind on the roof to speed up drawing out of the hot air and achieve the object of even faster ventilation and heat extraction. And from another side, heat flow passes through the first air vent 42 and the fifth air vent 46 to arrive at the expel air vent 54, thereby adding an additional channel for expelling hot air. When its raining, the rain water flows into the guide plate 53 from the expel air vent 54, whereupon the guide plate 53 expels the rain water through the overflow holes 5323 in the left crooked plate 532.

In the present invention, the left side of the guide plate 53 is provided with the upward facing left crooked plate 532 and the right side is provided with the upward facing right crooked plate 531, wherein apart from effecting a diverting function and narrowing the opening diameter of the second air vent 43, the opening diameter of the third air vent 44, and the opening diameter of the fourth air vent 45, the left crooked plate 532 also prevents blowing hot air toward rain water when the hot air is being expelled through the third air vent 44 and the fourth air vent 45, thus preventing the rain water from flowing back along the guide plate 53. Hence, the left crooked plate 532 is able to guide the streaming out of hot air, which prevents the streaming out of hot air blowing rain water and causing reverse flowing thereof. Moreover, during heavy rain, the guide plate 53 can temporarily store an accumulation of rain water therein (it is understood that the overflow holes 5323 also continually expel the rain water), thereby preventing spilling over to the first air vent 42. In addition, the right crooked plate 531 is able to block rain water from falling into the guide plate 53 and splashing out into the first air vent 42. In order to rapidly expel hot air from the interior of a house, the Bernouilli principle is further applied by making use of strong gusts of wind on the roof to speed up the drawing out of the hot air. Furthermore, the right crooked plate 531 and the left crooked plate 532 face each other, and are configured with the right crooked plate 531 positioned higher than the left crooked plate 532, which has the function similar to that of an overflow container, and can temporarily store water during extremely heavy rain, thus preventing the overflow of rain water that would otherwise normally fall into the first air vent 42 and then into the interior of a house.

Figure 8:
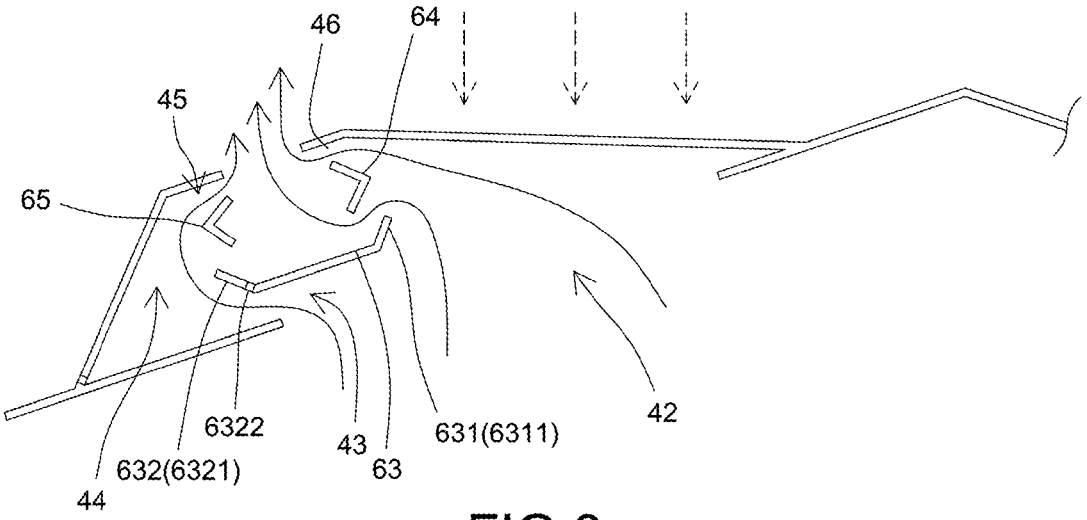
FIG. 8 is a cross-section schematic view of a second embodiment of the present invention.
Figure 9:
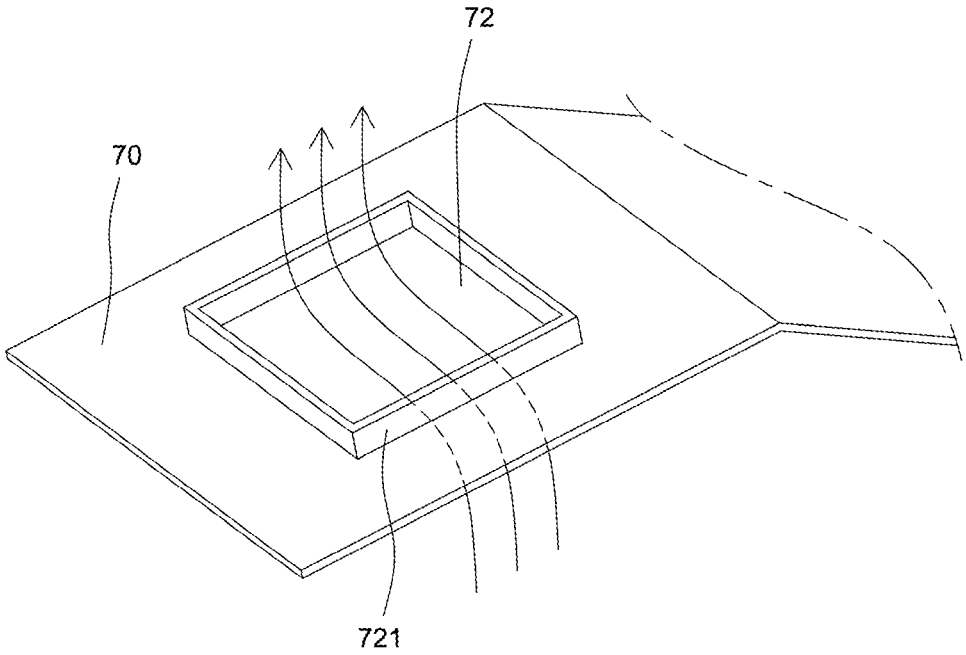
FIG. 9 is a three-dimensional schematic view of a third embodiment of the present invention applied on a flat surface roof.
Figure 10:
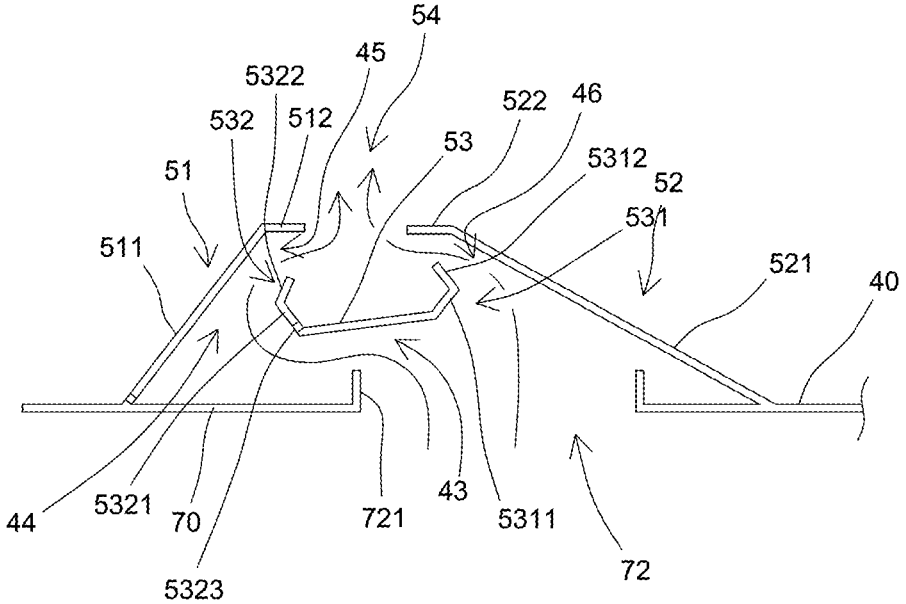
FIG. 10 is cross-section schematic view of the third embodiment of the present invention.

Referring to FIG. 8, which shows a second embodiment of the present invention, wherein a left crooked plate 632 of a guide plate 63 is a single left sloping plate 6321 facing upward at an angle. The left sloping plate 6321 is provided with a plurality of overflow holes 6322, and a right crooked plate 631 of the guide plate 63 is a single right sloping plate 6311 facing upward at an angle. A second left crooked plate 65 and a second right crooked plate 64 that face each other are further mounted above the guide plate 63, wherein the second left crooked plate 65 and the second right crooked plate 64 are both inverted V-shaped plates. In common with the first embodiment, apart from providing the guide plate 63 with a diverting function and narrowing the opening diameters of the second air vent 43, the third air vent 44, and the fourth air vent 45, use of the single upward angled left sloping plate 6321, the single upward angled right sloping plate 6311, and the separated second left crooked plate 65 and second right crooked plate 64 also prevents rain water from flowing back along the guide plate 63 when hot air is being expelled through the third air vent 44 and the fourth air vent 45. Hence, the left crooked plate 632 and the second left crooked plate 65 are able to guide the streaming out of hot air, preventing the streaming hot air from blowing toward the rain water and causing reverse flowing thereof. In addition, the right crooked plate 631 and the second right crooked plate 64 are able to block rain water from falling into the guide plate 63 and splashing out into the first air vent 42. In order to rapidly expel hot air from the interior of a house, the Bernouilli principle is further applied by making use of strong gusts of wind on the roof to speed up the drawing out of the hot air. Furthermore, the right crooked plate 631 and the left crooked plate 632 face each other and are configured with the right crooked plate 631 positioned higher than the left crooked plate 632, which has the function similar to that of an overflow container. The overflow area of the guide plate 63 is beyond the first air vent 42 and can temporarily store water during extremely heavy rain, thus preventing the overflow of rain water that would otherwise normally fall into the first air vent 42 and then into the interior of a house. Accordingly, the present invention is provided with multiple functions including hot air discharge, storing of excessive rain water, blocking rain water, and preventing leakage of rain water. Referring to FIGS. 9 and 10, which show a third embodiment of the present invention, wherein a water leakage top 70 is a flat surface rooftop, which is configured with a flange 721 on the periphery of a first air vent 72. The remaining devices are the same as those in the first embodiment.

Figure 1:
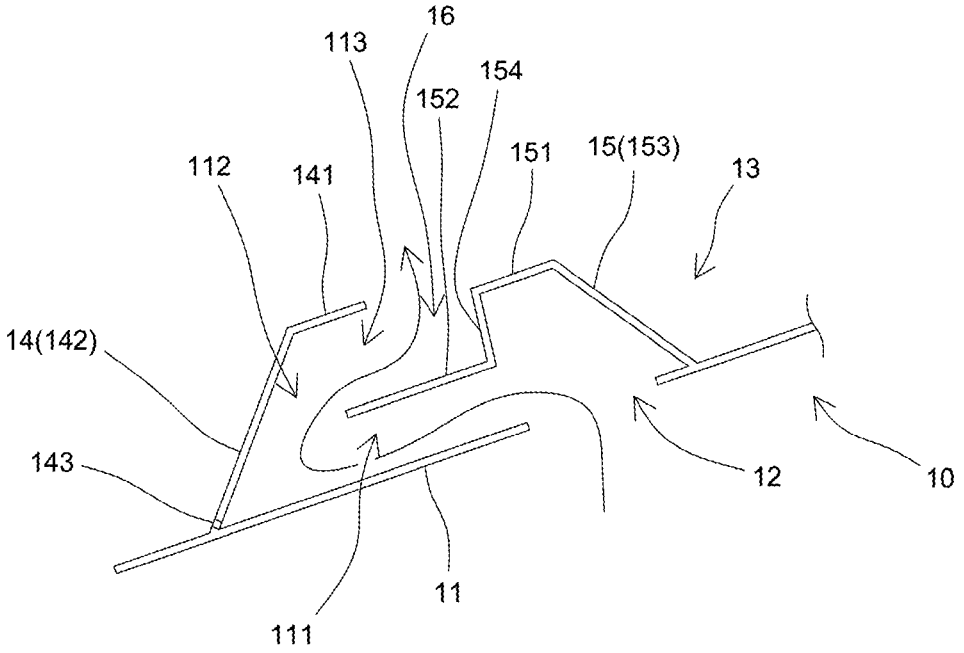
FIG.1 Prior Art
FIG. 1 is a cross-section schematic view of a heat extraction waterproof roof device (1) of the prior art.
Figure 2:
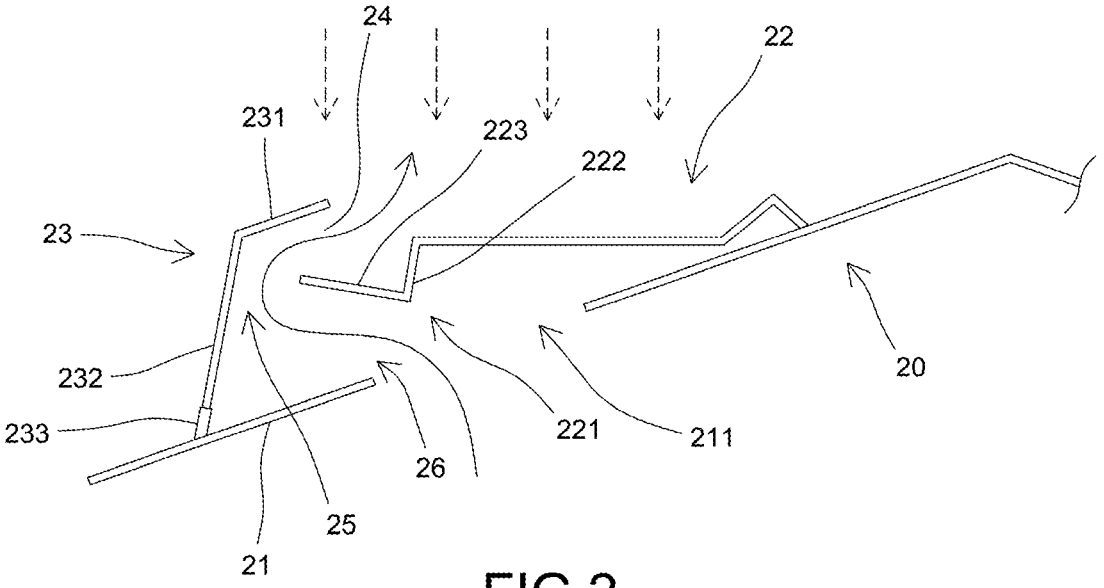
FIG.2 Prior Art
FIG. 2 is a cross-section schematic view of a heat extraction waterproof roof device (2) of the prior art.
Figure 3:
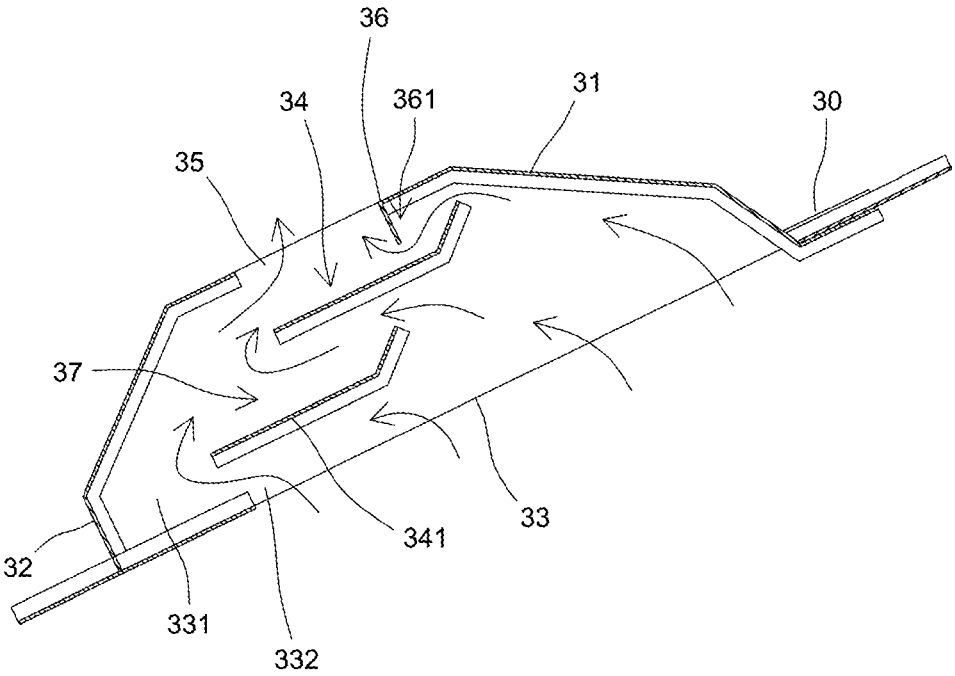
FIG.3 Prior Art
FIG. 3 is a cross-section schematic view of a heat extraction waterproof roof device (3) of the prior art.
Figure 4:
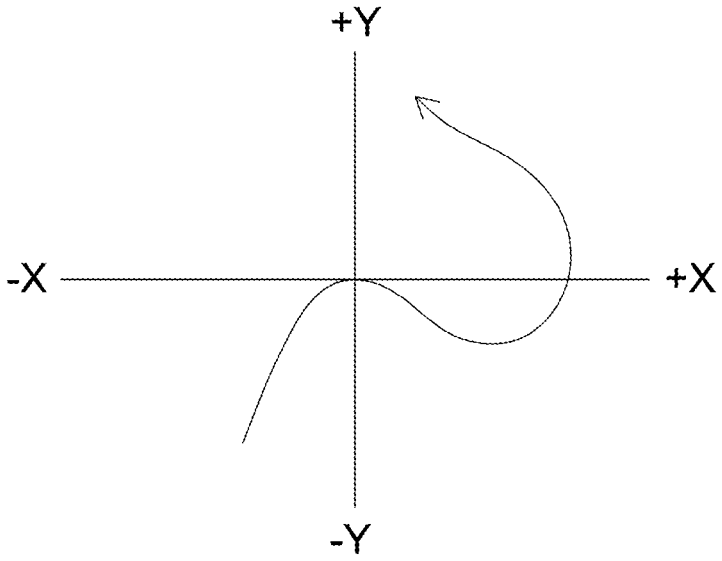
FIG.4 Prior Art
FIG. 4 is a schematic view of a X-Y axis heat extraction coordinate index of the roof air discharge heat dissipating device of FIG. 1 and FIG. 3.
Figure 11:
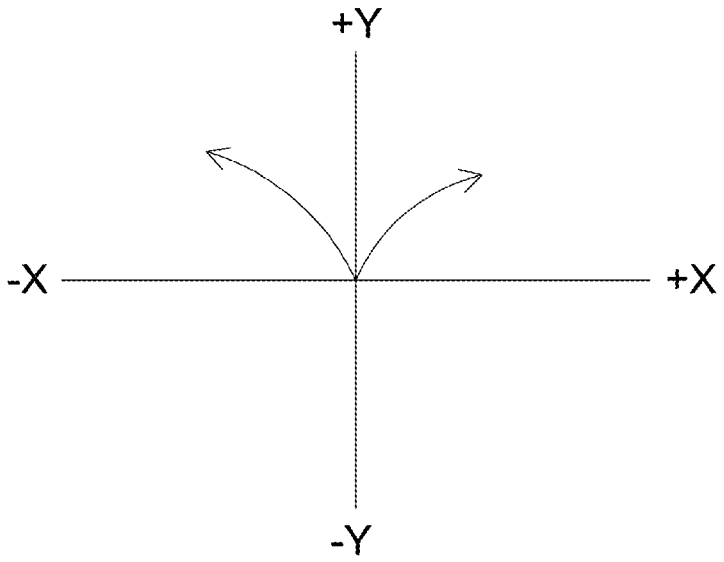
FIG. 11 is a schematic view of a X-Y axis heat extraction coordinate index of the present invention.

Referring to FIG. 11, which shows a X-Y axis coordinate index (which can be compared to the X-Y axis heat extraction coordinate index of an air discharge heat dissipation device of the prior art shown in FIG. 4), wherein the X-axis is the coordinate positions of horizontal displacement of hot air flow, and the Y-axis is the coordinate positions of vertical displacement of hot air flow. When the coordinate positions of hot air flow is on the negative Y-axis, a phenomenon occurs to counter the rising force of the hot air, making it difficult for the hot air to flow. In the present invention, the coordinate positions of the hot air flow are all on the positive Y-axis, with no phenomenon occurring that counters the rising force, thus, the hot air flow does not slow down, and there is no downward accumulation. On the contrary, the present invention applies the forward flow of the rising force of hot air and the additional effect of the Bernouilli principle to make use of strong gusts of wind on the roof to cause rapid flow of the hot air, thereby achieving an extremely good heat extraction effect.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A heat extraction, waterproof, and daylighting roof device, which comprises a water leakage top assembled on a roof, wherein the water leakage top is a top plate, a first air vent is provided in the water leakage top and is configured with a left end edge and a right end edge; a left extension water leakage top, a right extension water leakage top, and a guide plate are assembled above the first air vent, the right extension water leakage top is provided with a right sloping plate and a right top plate, the left extension water leakage top is positioned on the left side of the right extension water leakage top, the left extension water leakage top is provided with a left top plate and a left sloping plate, water leakage holes are provided between the left sloping plate and the water leakage top, the left top plate and the right top plate are approximately parallel with the water leakage top, an expel air vent is provided between the left top plate and the right top plate, the left extension water leakage top and the right extension water leakage top and two side elevations therebetween form an elevated body; the guide plate is positioned below the left extension water leakage top and the right extension water leakage top and above the water leakage top;

wherein, the guide plate is provided with an upward facing right crooked plate and an upward facing left crooked plate on two sides thereof, the guide plate is positioned on a connecting line between the end portion of the left top plate and the left end edge of the first air vent, wherein the left crooked plate is an inverted V-shaped plate, which is provided with a left lower plate and a left upper plate; the left lower plate is further provided with a plurality of overflow holes, and the right crooked plate is an inverted V-shaped plate, which is provided with a right lower plate and a right upper plate; an overflow area of the guide plate is beyond the first air vent; the guide plate and the water leakage top form a second air vent, the left crooked plate and the left sloping plate form a third air vent, and the left crooked plate and the left top plate form a fourth air vent, wherein the opening diameter of the first air vent is larger than the opening diameter of the second air vent; a fifth air vent is provided between the right crooked plate and the right extension water leakage top, the left crooked plate is positioned lower than the right crooked plate, which apart from guiding and preventing reverse flow of rain water when hot air is being expelled, thereby enabling temporary storage of accumulated rain water during heavy rain and prevents spilling over to the first wind vent.

2. A heat extraction, waterproof, and daylighting roof device, which comprises a water leakage top assembled on a roof, wherein the water leakage top is a top plate, a first air vent is provided in the water leakage top, and the first air vent is configured with a left end edge and a right end edge, a left extension water leakage top, a right extension water leakage top, and a guide plate are assembled above the first air vent, the right extension water leakage top is provided with a right sloping plate and a right top plate, the left extension water leakage top is positioned on the left side of the right extension water leakage top, the left extension water leakage top is provided with a left top plate and a left sloping plate, water leakage holes are provided between the left sloping plate and the water leakage top, the left top plate and the right top plate are approximately parallel with the water leakage top, an expel air vent is provided between the left top plate and the right top plate, the left extension water leakage top and the right extension water leakage top and two side elevations therebetween form an elevated body, the guide plate is positioned below the left extension water leakage top and the right extension water leakage top and above the water leakage top;

wherein, the guide plate is provided with an upward facing right crooked plate and an upward facing left crooked plate on two sides thereof, the guide plate is positioned on a connecting line between the end portion of the left top plate and the left end edge of the first air vent; the left crooked plate is a left sloping plate facing upward at an angle, wherein the left lower plate is provided with a plurality of overflow holes, and the right crooked plate is a right sloping plate facing upward at an angle; a second left crooked plate and a second right crooked plate that face each other are further mounted above the guide plate, wherein the second left crooked plate and the second right crooked plate are both inverted V-shaped plates, an overflow area of the guide plate is beyond the first air vent; the guide plate and the water leakage top form a second air vent, the left crooked plate and the left sloping plate form a third air vent, and the left crooked plate and the left top plate form a fourth air vent, wherein the opening diameter of the first air vent is larger than the opening diameter of the second air vent; a fifth air vent is provided between the right crooked plate and the right extension water leakage top; the left crooked plate is positioned lower than the right crooked plate, which apart from guiding and preventing reverse flow of rain water when hot air is being expelled, thereby enabling temporary storage of accumulated rain water during heavy rain and prevents spilling over to the first wind vent.

3. The heat extraction, waterproof, and daylighting roof device according to claim 1, wherein the left extension water leakage top and the right extension water leakage top and two side elevations therebetween form an elevated body, and are all made from light-transmitting material.

4. The heat extraction, waterproof, and daylighting roof device according to claim 2, wherein the left extension water leakage top and the right extension water leakage top and two side elevations therebetween form an elevated body, and are all made from light-transmitting material.

5. The heat extraction, waterproof, and daylighting roof device according to claim 1, wherein the water leakage top is a flat surface rooftop, and a flange is configured on the periphery of a first air vent.

6. The heat extraction, waterproof, and daylighting roof device according to claim 2, wherein the water leakage top is a flat surface rooftop, and a flange is configured on the periphery of a first air vent.

7. The heat extraction, waterproof, and daylighting roof device according to claim 1, wherein the opening diameter of the second air vent is larger than the opening diameter of the third air vent, and the opening diameter of the third air vent is larger than the opening diameter of the fourth air vent.

8. The heat extraction, waterproof, and daylighting roof device according to claim 2, wherein the opening diameter of the second air vent is larger than the opening diameter of the third air vent, and the opening diameter of the third air vent is larger than the opening diameter of the fourth air vent.

* * * * *